US007493063B2

(12) United States Patent
Takuma et al.

(10) Patent No.: US 7,493,063 B2
(45) Date of Patent: Feb. 17, 2009

(54) IMAGE-FORMING DEVICE COMPRISING A CONTACT CHARGING UNIT

(75) Inventors: Yasuo Takuma, Hitachi (JP); Masashi Yamamoto, Hitachi (JP); Masanari Fujita, Hitachi (JP)

(73) Assignee: Ricoh Company, Ltd., Tokyo (JP)

( * ) Notice: Subject to any disclaimer, the term of this patent is extended or adjusted under 35 U.S.C. 154(b) by 354 days.

(21) Appl. No.: 11/461,167

(22) Filed: Jul. 31, 2006

(65) Prior Publication Data

US 2007/0025772 A1 Feb. 1, 2007

(30) Foreign Application Priority Data

Aug. 1, 2005 (JP) ..... P2005-223044

(51) Int. Cl.
*G03G 15/02* (2006.01)
*G03G 21/18* (2006.01)

(52) U.S. Cl. ..... 399/176; 399/115

(58) Field of Classification Search ..... 399/115, 399/174, 176

See application file for complete search history.

(56) References Cited

U.S. PATENT DOCUMENTS 5,629,755 A * 5/1997 Ohtsuka ..... 399/176
5,638,158 A * 6/1997 Sanpe et al. ..... 399/174
5,842,081 A * 11/1998 Kaname et al. ..... 399/50
7,142,794 B2 * 11/2006 Fujita et al. ..... 399/100
2006/0165438 A1 * 7/2006 Takuma et al. ..... 399/128

FOREIGN PATENT DOCUMENTS

| | | |
|---|---|---|
| JP | 63-149668 | 6/1988 |
| JP | 06-348112 | 12/1994 |
| JP | 7-234569 | 9/1995 |
| JP | 10-198132 | 7/1998 |

* cited by examiner

*Primary Examiner*—David M Gray
*Assistant Examiner*—Joseph S. Wong
(74) *Attorney, Agent, or Firm*—Whitham Curtis Christofferson & Cook, P.C.

(57) ABSTRACT

An image-forming device including a plurality of supporting rollers, a photosensitive belt, a pressing roller, an intermediate roller, and a charging roller. The plurality of supporting rollers includes a preselected supporting roller. The photosensitive belt is circularly movably supported on the plurality of supporting rollers. The pressing roller is disposed to contact the photosensitive belt and to press the preselected supporting roller through the photosensitive belt. The intermediate roller is disposed away from the photosensitive belt and to contact the pressing roller. The intermediate roller is rotatable following rotation of the pressing roller. The charging roller is disposed to contact both the photosensitive belt and the intermediate roller and to press the preselected supporting roller through the photosensitive belt. The charging roller is rotatable following rotation of the intermediate roller to thereby charge the photosensitive belt.

7 Claims, 2 Drawing Sheets

| PRESSING LOAD [N] | OCCURENCE OF LATERAL STRIPE |
|---|---|
| 2. 0 | ○ |
| 2. 2 | ○ |
| 2. 4 | ○ |
| 2. 6 | ○ |
| 2. 7 | ○ |
| 2. 9 | × |
| 3. 1 | × |
| 3. 3 | × |
| 3. 5 | × |
| 3. 7 | × |
| 3. 9 | × |

IMAGE-FORMING DEVICE COMPRISING A CONTACT CHARGING UNIT

BACKGROUND OF THE INVENTION

The present invention relates to an image-forming device such as an electrophotographic printer or a copying machine, in particular, an image-forming device having a primary charger for charging a photosensitive belt.

In the image-forming device such as the electrophotographic printer and the copying machine, a charger charges a charged object as a photosensitive body rotating in a direction to a predetermined potential $V_0$ by corona discharge. Charging by corona discharge has a good property of uniformly charging the photosensitive body. However, since a high voltage of about 4 through 6 kv in direct current is used, any amount of ozone is generated at the occurrence of corona, which causes environmental damage. As a countermeasure, Japanese Examined Patent Application No. H3-52058 discloses a contact-type charger which charges a photosensitive body to a desired potential by relatively low voltage. The contact-type charger has a roller that generates an extremely small amount of ozone and contacts the photosensitive body. An alternating voltage is applied to the contact-type charger.

The charger disclosed in Japanese Examined Patent Application No. H3-52058 achieves uniform charging the photosensitive body with the generation of an extremely small amount of ozone (about one-tenth through one-hundredth as compared to the charger using corona discharge). Since the charger disclosed in Japanese Examined Patent Application No. H3-52058 has a high capability of eliminating potential history on the photosensitive body, an eliminating process (an eliminating device) prior to a charging process is not required and thus, the size of the image forming apparatus can be reduced. However, in this charger, size of an alternating voltage source of this charger is lager than that of direct voltage source and vibration noise is generated at a nip area between the charger and the photosensitive body due to an AC electric field therebetween.

A method of charging the photosensitive body by using DC electric field without using the AC electric field is disclosed in Japanese Patent Application Publication No. H6-348112, for example. According to the method described in Japanese Patent Application Publication No. H6-348112, when only DC voltage is applied to a charger, a surface of a photosensitive body tends to be nonuniformly charged. Then, striped unevenness of charging having 2 through 200 mm in length and 0.5 mm or less in width in a direction perpendicular to a moving direction of the surface of the photosensitive body occurs thereon. The striped unevenness of charging on the photosensitive body appears as an image defect such as a black stripe in reverse development method and a white stripe in nonreverse development method (a white stripe occurs in all black or halftone).

Japanese Patent Application Publication No. H10-198132 describes a charging method in which a charger charges a photosensitive body at gaps between a charging roller and the photosensitive body on upstream and downstream sides in a rotational direction of the photosensitive body with respect to a contact position of the charging roller and the photosensitive body. In this charging method, difference in potential between the charging roller and the surface of the photosensitive body is insufficiency, resulting in unstable discharging therebetween. Thus, the surface of the photosensitive body is nonuniformly charged, thereby appearing the above-described black or white stripe on a recording medium As a solution for the above-described problem, Japanese Patent Application Publication No. H6-348112 discloses a charging method in which the charging potential on an electrophotographic photosensitive body is set within the range of 300 through 650V. Further, in the charging method of Japanese Patent Application Publication No. H10-198132, the charging roller charges the photosensitive body in the gap only on the downstream side, while an erasing device removes potential from the surface of the photosensitive body on the upstream side of the contact position.

According to the charging method in Japanese Patent Application Publication No. H6-348112, a photocarrier on the photosensitive body generated by being exposed to a laser beam of the erasing device may remain on the photosensitive body even after the passage through nip area between the charging roller and the photosensitive body, thereby eliminating the potential charged by the charging roller in the gap on the downstream side. This leads to low charging efficiency and nonuniform charging. Consequently, when a distance between the most downstream point of an irradiation region of the erasing device and the charge starting point of the charger is defined as L(mm), a moving speed of photosensitive body is defined as V(mm/sec) and a life of the photocarrier on the surface of the photosensitive body generated by being exposed to the laser beam of the erasing device is defined as $\tau$ (sec), uniform charging on the surface of the photosensitive body is achieved by setting the $L/V \geqq \tau$.

SUMMARY

The inventors reveals, in the charging method of Japanese Patent Application Publication No. H6-348112, that even when the charging potential on the photosensitive body is set within the range of 300-650V, striped unevenness of charging occurs. In the charging method of Japanese Patent Application Publication No. H10-198132, the inventors also reveals that the charging method, in which the charging roller charges the photosensitive body in the gap only on the downstream side, do not uniformly charge the surface of the photosensitive body and tends to form rough image when printing a halftone image as compared with a charging method in which the charging roller charges the photosensitive body in the gap on the upstream side.

Next, a cause why the above-mentioned problem occurs will be described After the photosensitive body is charged by the charging roller in the gap on the upstream side, in a nip area where the charging roller contacts the photosensitive body, the contact state of the charging roller with the photosensitive body microscopically changes due to slip-stick phenomenon Thus, since the time when the charging roller passes the nip area varies by a part of the charging roller, amount of charge on the surface of the charging roller is ununiformity. Accordingly, immediately after the charging roller passes the nip area, the photosensitive body is partially charged in the gap on the downstream side. As a result, striped unevenness of charging occurs on the surface of the photosensitive body. The striped unevenness of charging especially appears when the photosensitive body, like a belt-like photosensitive body, has a flexibility.

The striped unevenness of charging also depends on a resistance value of the charging roller. When the resistance value of the charging roller is high, amount of charge on the surface of the charging roller is insufficient in the gap on the upstream side and the electric field in the gap on the upstream side does not become the discharge start electric field or higher. On the contrary, since the electric field in the gap on the downstream side become the discharge start electric field or higher, the surface of the photosensitive body is charged in the gap only on the downstream side. The surface of the photosensitive body is charged to be a relative high potential by a change over time of the electric field in the gap on the downstream side due to the separating operation of the charging roller from the photosensitive body. In the case of the flexible photosensitive belt, the separating operation is microscopically ununiform and charging also tends to be ununiform On the other hand, when the resistance value of the charging roller is low, the surface of the charging roller is sufficiently charged in the gap on the upstream side and the electric field in the gap on the upstream side becomes the discharge start electric field or higher. Thus, the charging roller starts discharging in the gap on the upstream side and the surface of the photosensitive body is sufficiently charged. Thus, the charging roller does not discharge in the gap on the downstream side. Since the discharge of the charging roller in the gap on the upstream side stops at the nip area, the discharging of the charging roller in the gap on the upstream side is more stable than the discharging of the charging roller in the gap on the downstream side. Accordingly, the surface of the photosensitive body is charged to a proper potential.

When the resistance value of the charging roller is middle, the charging roller discharges in the gap on the upstream side as well as in the gap on the downstream side. In this case, if discharging in the gap on the upstream and downstream sides uniformly generates on any position of the charging roller, no striped unevenness of charging appears. As described above, however, when the contact state of the charging roller with the photosensitive body in the nip area microscopically changes due to slip-stick phenomenon, discharging in the gap on the downstream side ununiformly occurs by a part of the charging roller, thereby causing the striped unevenness of charging. The striped unevenness of charging is improved by setting the resistance value of the charging roller to be lower than a predetermined value.

If the photocarrier generated by being exposed to the laser beam of the erase device exists on the photosensitive body, the charge on the surface of the photosensitive body charged in the gap on the upstream side is erased in the nip area. Accordingly, even if the resistance value of the charging roller is set to be lower than the predetermined value, the charging roller discharged in the gap on the downstream side. To prevent this, a time constant of the generated photocarrier and an amount of eventual remaining photocarrier in the vicinity of the charging roller need to be a predetermined value or less. Thus, it is difficult to select a material for the photosensitive body.

In view of the foregoing, it is an object of the present invention to provide an image-forming device that is capable of preventing the occurrence of the striped unevenness of charging by suppressing slip-stick phenomenon and achieving high-quality image formation.

This and other object of the invention will be attained by an image-forming device including a plurality of supporting rollers, a photosensitive belt, a pressing roller, an intermediate roller, and a charging roller.

The plurality of supporting rollers includes a preselected supporting roller rotatable about a first rotational axis. The photosensitive belt is circularly movably supported on the plurality of supporting rollers. The pressing roller is rotatable about a second rotational axis and disposed to contact the photosensitive belt and to press the preselected supporting roller through the photosensitive belt. The intermediate roller is rotatable about a third rotational axis and disposed away from the photosensitive belt and to contact the pressing roller. The intermediate roller is rotatable following rotation of the pressing roller. The charging roller is rotatable about a fourth rotational axis and is disposed to contact both the photosensitive belt and the intermediate roller and to press the preselected supporting roller through the photosensitive belt. The charging roller is rotatable following rotation of the intermediate roller to thereby charge the photosensitive belt. The first, second, third and fourth rotational axes are in parallel to one another.

DETAILED DESCRIPTION

Figure 1:
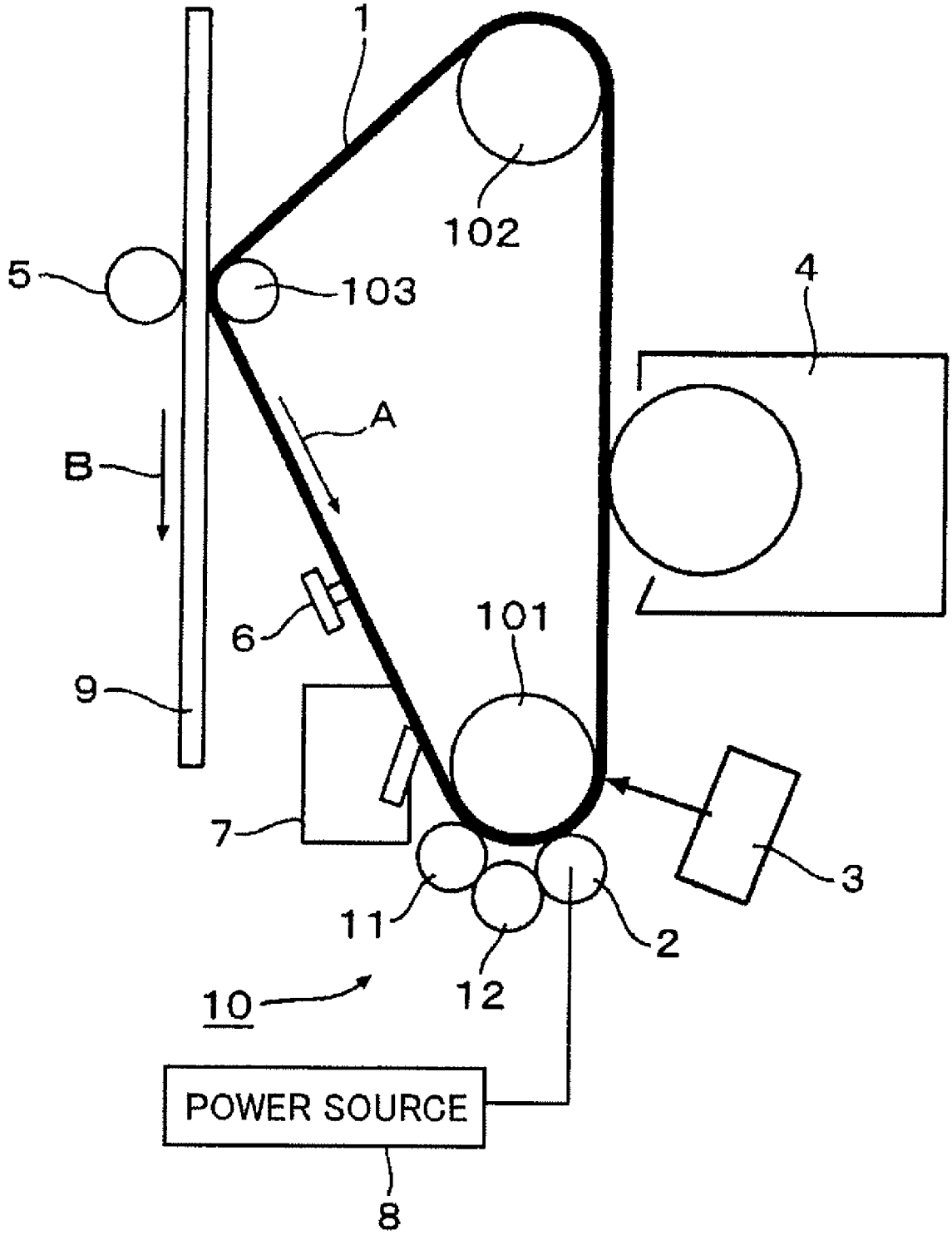
FIG. 1 is a schematic view of an image-forming device in accordance with an embodiment of the present invention.
Figures 2, 3:
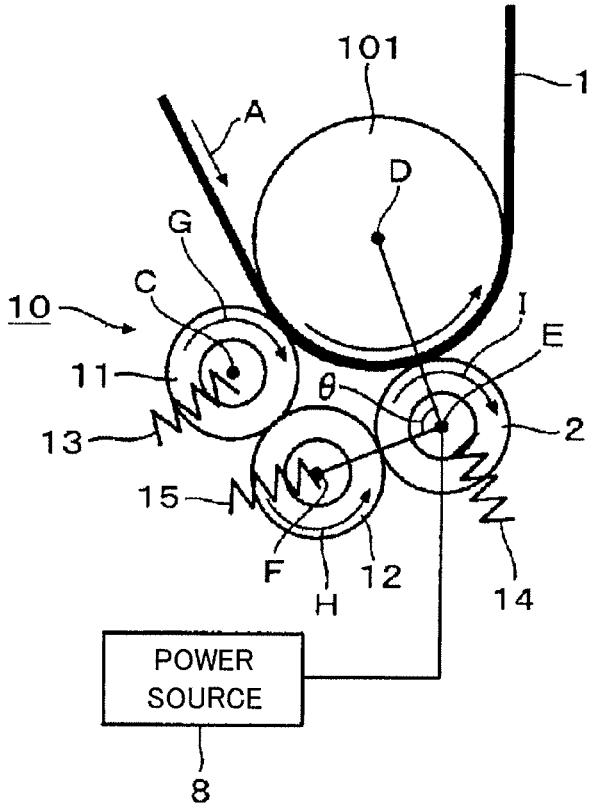
FIG. 2 is an enlarged view of a primary charger of the image-forming device in accordance with the embodiment of the present invention.
FIG. 3 is a relationship between the pressing load of charging roller against the photosensitive belt and occurrence of lateral stripe on the photosensitive belt.

An image-forming device according to preferred embodiments of the present invention will be described while referring to the accompanying drawings. FIG. 1 is a schematic view of an image-forming device according to preferred embodiment of the present invention. FIG. 2 is an enlarged view of a primary charger in FIG. 1.

As shown in FIG. 1, an image-forming device 20 includes a photosensitive belt 1, a primary charger 10, an exposure device 3, a developing device 4, a transfer device 5, an erasing device 6, and a cleaning device 7. The photosensitive belt 1 is supported on supporting rollers 101, 102 and 103. The photosensitive belt 1 is formed of a polyethylene terephthalate (PET) film that is a photosensitive material is coated, for example. The photosensitive belt 1 has flexibility. The photosensitive belt 1 is circularly moved around the supporting rollers 101, 102 and 103 by a drive source (not shown) in a direction indicated by an arrow A in FIG. 1. An electrode layer of the photosensitive belt 1 is grounded. The primary charger 10, exposure device 3, developing device 4, transfer device 5, erasing device 6 and cleaning device 7 are arranged along the rotating direction of the photosensitive belt 1 in this order. In this embodiment, diameter of the supporting roller 101 is about 8-20 mm. Length of the supporting roller 101 is about 210 mm or 300 mm. The supporting roller is rotatable about a shaft center D.

The primary charger 10 uniformly charges the surface of the photosensitive belt 1. The exposure device 3 irradiates laser beam onto the surface of the photosensitive belt 1 to form an electrostatic latent image thereon based on data transmitted from a host device (not shown) The development device 4 accommodates toner and supplies the toner to the electrostatic latent image on the surface of the photosensitive belt 1 to form a visible image. The transfer device 5 transfers the visible image on the photosensitive belt 1 to a sheet 9. The erasing device 6 irradiates light onto the surface of the photosensitive belt 1 to initialize the potential on the surface of the photosensitive belt 1. The cleaning device 7 removes toner remaining on the photosensitive belt 1 without being transferred to the sheet 9.

Next, a printing operation of the image-forming device 20 will be described. The printing operation is started by reception of a print start signal from a host device (not shown). When the printing operation is started, the photosensitive belt 1 is moved around by the supporting rollers 101, 102 and 103 in the direction A, and the surface of the photosensitive belt 1 is charged to a predetermined potential $V_0$ (for example, −400V) by the primary charger 10. Subsequently, the exposure device 3 irradiates a laser beam onto the surface of the photosensitive belt 1 to form an electrostatic latent image thereon. The electrostatic latent image is developed as a visible image by the development device 4. After that, the visible image is transferred to the sheet 9 by the transfer device 5. Then, the sheet 9 is conveyed toward a fixing device (not shown) and the unfixed visible image is fixed to the sheet 9 by the fixing device (not shown).

After transfer of the visible image on the sheet 9, the potential of the surface of the photosensitive belt 1 is initialized through the light from the erasing device 6. Next, the toner remaining on the photosensitive belt 1 without being transferred to the sheet 9 is removed by the cleaning device 7.

Although the electrode layer of the photosensitive belt 1 is grounded, voltage may be applied to the electrode layer of the photosensitive belt 1. In this case, voltage value of a charging roller 2 (described later) is a voltage value that added the voltage applied to the electrode layer of the photosensitive belt 1 to the voltage value of the charging roller 2 when being grounded the electric layer of the photosensitive belt 1.

Next, the primary charger 10 will be described in detail. As shown in FIGS. 1 and 2, the primary charger 10 has the charging roller 2, a pressing roller 11 and an intermediate roller 12. The charging roller 2 is rotatable about a shaft center E. The pressing roller 11 is rotatable about a shaft center C. The intermediate roller 12 is rotatable about a shaft center F. The shaft centers C, D, E and F are in parallel to one another. A power source 8 applies a high voltage to charging roller 2 for charging the surface of the photosensitive belt 1. The pressing roller 11 is pressed and contacted to the photosensitive belt 1 thereby rotating following the circularly movement of the photosensitive belt 1. The intermediate roller 12 is disposed between the charging roller 2 and the pressing roller 11 The charging roller 2 is formed of a conductive rubber roller, and the pressing roller 11 and the intermediate roller 12 are formed of a rubber roller respectively. The charging roller 2 and the pressing roller 11 are in contact with the photosensitive belt 1 and the intermediate roller 12 is not in contact with the photosensitive belt 1. In this embodiment, diameters of the charging roller 2, the pressing roller 11 and the intermediate roller 12 are about 8-20 mm and lengths of the charging roller 2, the pressing roller 11 and the intermediate roller 12 are about 210 mm or 300 mm.

As shown in FIG. 2, the pressing roller 11 is pressed against the supporting roller 101 through the photosensitive belt 1 by a first spring 13 so that the pressing roller 11 rotates following the rotation of the supporting roller 101. At this time, the first spring 13 urges the pressing roller 11 from the shaft center C of the pressing roller 11 toward the shaft center D of the supporting roller 101 with pressing load of about 5[N].

The charging roller 2 is urged by a second spring 14 from the shaft center E of the charging roller 2 toward the shaft center D of the supporting roller 101 and is in contact with the photosensitive belt 1, though not rotating following the circularly movement of the photosensitive belt 1.

For rotating the charging roller 2 following the circularly movement of the photosensitive belt 1, the charger roller 2 needs to come into contact with the photosensitive belt 1 with pressing load of about 3[N] or more. On the contrary, for not rotating the charging roller 2 following the circularly movement of the photosensitive belt 1, the charger roller 2 needs to come into contact with the photosensitive belt 1 with pressing load of about 2.7[N] or less.

The intermediate roller 12 is disposed so that a distance between the shaft center F of the intermediate roller 12 and the shaft center C of the pressing roller 11 become a predetermined distance. The intermediate roller 12 rotates following the rotation of the pressing roller 11. The pressing load between the rollers 11 and 12 is set to be about 5[N].

Further, the intermediate roller 12 is disposed so that a imaginary plane D-E defined by a plane including the shaft center D of the supporting roller 101 and the shaft center E of the charging roller 2 and a imaginary plane E-F defined by a plane including the shaft center E of the charging roller 2 and the shaft center F of the intermediate roller 12 form an angle θ equal to or less 90 degrees. The intermediate roller 12 is pressed against the charging roller 2 by a third spring 15 from the shaft center F toward the shaft center E with pressing load of about 5[N].A wall (not shown) is disposed adjacent to a bearing of the charging roller 2 for receiving the pressing load of the third spring 15. Thus, the wall (not shown) prevents the shaft center E of the intermediate roller 12 from shifting by the pressing load applied to the intermediate roller 12. By setting the angle θ of 90 degrees or less, the charging roller 2 can be prevented from pressing against the photosensitive belt 1 by the pressing load urged from the third spring 15 to the charging roller 2.

Accordingly, the pressing roller 11 rotates following circularly movement of the photosensitive belt 1 in a direction indicated by an arrow G. This rotational force of the pressing roller 11 is transmitted to the intermediate roller 12. Then, the intermediate roller 12 rotates following rotation of the pressing roller 11 in a direction indicated by an arrow H. The rotational force of the intermediate roller 12 is transmitted to the charging roller 2. Then, the charging roller 2 rotates following rotation of the intermediate roller 12 in a direction indicated by an arrow I. Accordingly, these three rollers 2, 11 and 12 rotate at a constant speed.

Consequently, the charging roller 2, for charging the surface of the photosensitive belt 1 to a desired potential, rotates at the same speed as that of the photosensitive belt 1. The charging roller 2 is in slightly contact with the photosensitive belt 1 at a contact area in which the charging roller 2 contacts the photosensitive belt 1, that is, the area where discharging between the charging roller 2 and the photosensitive belt 1, so as not to rotate following circularly movement of the photosensitive belt 1. Accordingly, slip-stick phenomenon accompanying minute deformation of the surface of the photosensitive belt 1 can be suppressed. Further, occurrence of striped unevenness of charging on the photosensitive belt 1 can be prevented, thereby achieving high-quality image formation without any image disturbance in the image-forming device 20.

The inventors have conducted an experiment to see the relationship between the pressing load of charging roller 2 against the photosensitive belt 1 and occurrence of lateral stripe on the photosensitive belt 1 FIG. 3 shows the results of this experiment. The experiment was conducted under experimental conditions of 10° C. temperature and 20% humidity using the image-forming 1 with the above-described configuration. A rotation speed of the photosensitive belt 1 was 200 nm/sec. However, the rotation speed of the photosensitive belt 1 may be 30-250 mm/sec. In this experiment, the presence or absence of occurrence of a lateral stripe, when changing a load applied to both ends of the charging roller 2 in the shaft direction, is checked with eyes. The lateral strip has length and width in a direction perpendicular to a moving direction of the surface of the photosensitive belt 1. Note that "O" in FIG. 3 indicates no occurrence of lateral stripe on the surface of the photosensitive belt 1, and "x" indicates occurrence of lateral stripe on the surface of the photosensitive belt 1.

As will be understood from FIG. 3, when the pressing load of the charging roller 2 against the photosensitive belt 1 is 2.7[N] or less (that is, the load applied to each end of the charging roller 2 in the shaft direction is 140 g), no lateral strip occurs on the surface of the photosensitive belt 1. On the contrary, when the pressing load of the charging roller 2 is more than 2.7 N, the charging roller 2 rotates following circularly movement of the photosensitive belt 1. As a result, slip-stick phenomenon occurs at the discharge area (the contact area of the photosensitive belt 1 with the charging roller 2), thereby occurring the lateral stripe on the surface of the photosensitive belt 1.

Therefore, to suppress the occurrence of the lateral stripe on the surface of the photosensitive belt 1 and put the image-forming device 1 to practical use, the pressing load of the second spring 14 of the charging roller 2 against photosensitive belt 1 needs to be 2.7 [N] or less. When the pressing load of the charging roller 2 against the photosensitive belt 1 is too small, the contact state of the charging roller 2 with the photosensitive belt 1 becomes unstable. Since this can lead to unstable charging of the surface of the photosensitive belt 1, it is preferred that the pressing load of the charging roller 2 against the photosensitive belt 1 is set to be 2.0 [N] or more.

The primary charger 10 is also applicable in the case where it is necessary to stably charge a photosensitive body and makes electrical potential of the photosensitive body uniform.

What is claimed is:

1. An image-forming device comprising:

a plurality of supporting rollers including a preselected supporting roller rotatable about a first rotational axis;

a photosensitive belt that is circularly movably supported on the plurality of supporting rollers;

a pressing roller that is rotatable about a second rotational axis and disposed to contact the photosensitive belt and to press the preselected supporting roller through the photosensitive belt;

an intermediate roller that is rotatable about a third rotational axis and disposed away from the photosensitive belt and to contact the pressing roller, the intermediate roller being rotatable following rotation of the pressing roller; and a charging roller that is rotatable about a fourth rotational axis and is disposed to contact both the photosensitive belt and the intermediate roller and to press the preselected supporting roller through the photosensitive belt, the charging roller being rotatable following rotation of the intermediate roller to thereby charge the photosensitive belt, wherein the first, second, third and fourth rotational axes are in parallel to one another.

2. The image-forming device according to claim 1, wherein a first imaginary plane defined by a plane including the first rotational axis and the fourth rotational axis and a second imaginary plane defined by a plane including the third rotational axis and the fourth rotational axis form an angle equal to or less than 90 degrees.

3. The image-forming device according to claim 1, wherein the charging roller is pressed against the photosensitive belt with a pressing load of 2.7 or less.

4. The image-forming device according to claim 1, wherein the charging roller is formed of a conductive rubber roller.

5. The image-forming device according to claim 1, wherein the photosensitive belt has flexibility.

6. The image-forming device according to claim 1, wherein the pressing roller is pressed against the preselected supporting roller in a direction from the second rotational axis toward the first rotational axis, the charging roller being pressed against the preselected supporting roller in a direction from the fourth rotational axis toward the first rotational axis, and the intermediate roller being pressed against the charging roller in a direction from the third rotational axis toward the forth rotational axis.

7. The image-forming device according to claim 1, further comprising:

an exposure device that forms an electrostatic latent image on the photosensitive belt; and a developing device that accommodates toner and supplies the toner to the electrostatic latent image on of the photosensitive belt.

* * * * *